US006982673B2

(12) United States Patent
Yuanzhu

(10) Patent No.: US 6,982,673 B2
(45) Date of Patent: Jan. 3, 2006

(54) INVERTED-F METAL PLATE ANTENNA HAVING INCREASED BANDWIDTH

(75) Inventor: Dou Yuanzhu, Fukushima-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/810,021

(22) Filed: Mar. 26, 2004

(65) Prior Publication Data

US 2004/0196195 A1 Oct. 7, 2004

(30) Foreign Application Priority Data

Apr. 3, 2003 (JP) ..... 2003-100438

(51) Int. Cl.
*H01Q 1/38* (2006.01)

(52) U.S. Cl. ..... 343/700 MS; 343/846

(58) Field of Classification Search ..... 343/700 MS, 343/846

See application file for complete search history.

(56) References Cited

U.S. PATENT DOCUMENTS 5,173,711 A * 12/1992 Takeuchi et al. ..... 343/700 MS
5,943,020 A * 8/1999 Liebendoerfer et al. .... 343/702
6,034,636 A * 3/2000 Saitoh ..... 343/700 MS
6,421,014 B1 * 7/2002 Sanad ..... 343/700 MS
6,448,932 B1 * 9/2002 Stoiljkovic et al. .. 343/700 MS
6,618,011 B2 * 9/2003 Eggleston et al. ... 343/700 MS
6,633,261 B2 * 10/2003 Iwai et al. ..... 343/700 MS
6,774,849 B2 * 8/2004 Umehara et al. .... 343/700 MS
2002/0101381 A1 * 8/2002 Segerstedt ..... 343/702

FOREIGN PATENT DOCUMENTS

JP 11-041026 2/1999
JP 2000-261243 9/2000

* cited by examiner

*Primary Examiner*—Tan Ho
(74) *Attorney, Agent, or Firm*—Brinks Hofer Gilson & Lione

(57) ABSTRACT

An inverted-F metal plate antenna is composed of a radiating conductor plate disposed opposing and substantially in parallel with a ground conductor surface, a power-feeding conductor plate extending substantially perpendicularly from an outer edge of the radiating conductor plate, and shorted conductor plates extending substantially perpendicularly from two points on outer edges of the radiating conductor plate and connected to the ground conductor surface. When a predetermined high-frequency electric power is supplied to the radiating conductor plate via the power-feeding conductor plate, a first resonance mode with a relatively long resonant length, in which one of the shorted conductor plate works as a shorted stub, and a second resonance mode with a relatively short resonant length, in which the other shorted conductor plate works as a shorted stub, are generated, causing excitation of the radiating conductor plate.

1 Claim, 3 Drawing Sheets

INVERTED-F METAL PLATE ANTENNA HAVING INCREASED BANDWIDTH

This application claims the benefit of priority to Japanese Patent Application No. 2003-100438, herein incorporated by reference.

BACKGROUND OF THE INVENTION

1. Field of the Invention

The present invention relates to an inverted-F metal plate antenna that can be suitably used, for example, as a small and inexpensive internal antenna for communication.

2. Description of the Related Art

Inverted-F metal plate antennas formed by bending metal plates are often used, for example, as internal antennas for communication, since inverted-F metal plate antennas can be manufactured relatively inexpensively and are advantageous for reducing size and height, and exhibit favorable antenna characteristics.

FIG. 5 is a perspective view of a common inverted-F metal plate antenna that has been known. Referring to FIG. 5, an inverted-F metal plate antenna 1 is fixed on a ground conductor surface 2 composed of a conductor plate or conductor foil. The inverted-F metal plate antenna 1 is formed by bending a sheet of metal plate. The inverted-F metal plate antenna I is composed of a radiating conductor plate 3 disposed opposing and in parallel with the ground conductor surface 2, a power-feeding conductor plate 4 extending substantially perpendicularly from an outer edge of the radiating conductor 3 and connected to a power-feeding circuit that is not shown, and a shorted conductor plate 5 extending substantially perpendicularly from an outer edge of the radiating conductor 3 and connected to the ground conductor surface 2. In the conventional inverted-F metal plate antenna 1, the lengthwise dimension of the radiating conductor 3 is chosen to be approximately one fourth of the resonant length so that when a predetermined high-frequency electric power is supplied to the radiating conductor plate 3 via the power-feeding conductor plate 4, the radiating conductor plate 3 is excited, allowing transmission and reception of signal waves in a predetermined frequency band associated with the resonant length.

The inverted-F metal plate antenna 1 constructed as described above, however, has a narrow resonant frequency band (bandwidth) in which the voltage to stationary wave ratio (VSWR) is not larger than 2 and the amount of reflection is not larger than −10 dB. For example, since the frequency band used in a wireless LAN that operates in the 5-GHz band is rather wide, an antenna for the wireless LAN must have a bandwidth at least as wide as 300 MHz, and preferably 500 MHz or larger. The inverted-F metal plate antenna 1 is not suitable for practical use since its bandwidth is only as wide as approximately 200 MHz.

In order to overcome the problem, a type of inverted-F metal plate antenna has been proposed in which another metal plate (shorted conductor plate) is connected and fixed at a position that is deviated by a predetermined amount from the center of the radiating conductor plate and in which the metal plate is connected and fixed on a ground conductor surface. This type of inverted-F antenna is disclosed, for example, in Japanese Unexamined Patent Application Publication No. 11-041026, at page 3 and in FIG. 1. In such an arrangement in which a shorted conductor plate is connected and fixed at a position that asymmetrically divides a radiating conductor plate in two, distances of the shorted conductor plate to substantially parallel two sides of the radiating conductor plate differ. Thus, two different resonant modes at different frequencies, reflecting the difference in distance, can be generated when power is supplied. This serves to increase the bandwidth of an inverted-F metal plate antenna.

The related art disclosed in Japanese Unexamined Patent Application Publication No. 11-041026 is effective for increasing the bandwidth of an inverted-F metal plate antenna. However, since a separate shorted conductor plate must be connected and fixed at a predetermined position of a radiating conductor plate by soldering or the like, manufacturing cost increases compared with a common inverted-F antenna, such as the one shown in FIG. 5, that can be formed by bending a sheet of metal plate. Furthermore, according to the related art disclosed in Japanese Unexamined Patent Application Publication No. 11-041026, since a shorted conductor plate is disposed at a position where a radiating conductor is divided in two, the lengthwise dimension of the radiating conductor plate must be chosen to be approximately one half of the resonant length. This prohibits miniaturization of the inverted-F metal plate antenna.

SUMMARY OF THE INVENTION

The present invention has been made in view of the situation of the related art, and an object thereof is to provide an inverted-F metal plate antenna that can be manufactured at a low cost and that has a wide bandwidth without sacrificing miniaturization.

The present invention provides an inverted-F metal plate antenna fixed on a ground conductor surface, including a radiating conductor plate disposed opposing and substantially in parallel with the ground conductor surface; a power-feeding conductor plate extending substantially perpendicularly from an outer edge of the radiating conductor plate and connected to a power-feeding circuit; and a plurality of shorted conductor plates extending substantially perpendicularly from a plurality of points on outer edges of the radiating conductor plate and connected to the ground conductor surface; wherein the plurality of shorted conductor plates are disposed such that when power is supplied, a plurality of resonance modes with different resonant lengths is generated respectively in association with the plurality of shorted conductor plates.

In the inverted-F metal plate antenna constructed as described above, shorted conductor plates extend from a plurality of points on outer edges of a radiating conductor plate (e.g., from two points at different distances from the power-feeding conductor plate). Thus, a plurality of resonance modes with different resonant lengths can be generated respectively in association with the shorted conductor plates. This serves to increase the resonant frequency band. Furthermore, even if the number of shorted conductor plates extending substantially perpendicularly from outer edges of the radiating conductor plate is increased, miniaturization is not compromised, and manufacturing cost is not increased.

DESCRIPTION OF THE PREFERRED EMBODIMENTS

Figure 1:
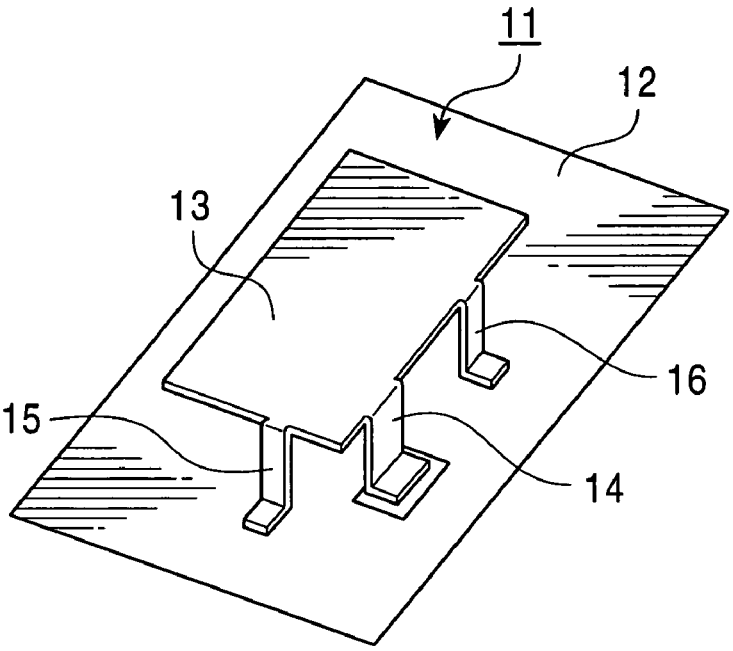
FIG. 1 is a perspective view of an inverted-F metal plate antenna according to an embodiment of the present invention.
Figure 2:
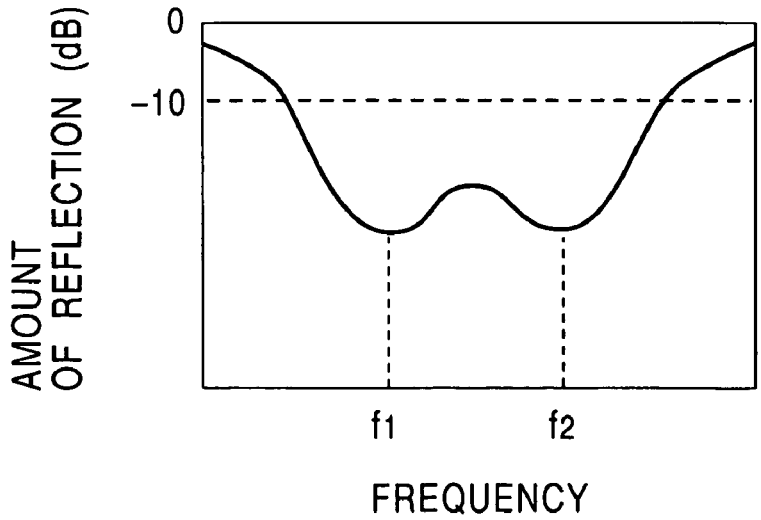
FIG. 2 is a graph showing reflection characteristics of the inverted-F metal plate antenna shown in FIG. 1.

Now, preferred embodiments of the present invention will be described with reference to the drawings. FIG. 1 is a perspective view of an inverted-F metal plate antenna according to an embodiment of the present invention. FIG. 2 is a graph showing reflection characteristics of the invented-F antenna.

Referring to FIG. 1, an inverted-F metal plate antenna 11 that is formed by bending a single metal plate is fixed on a ground conductor surface 12 composed of a conductor plate or conductor foil. The inverted-F metal plate antenna 11 is composed of a rectangular radiating conductor plate 13 disposed opposing and in parallel with the ground conductor surface 12, a power-feeding conductor plate 14 extending substantially perpendicularly from an outer edge of the radiating conductor plate 13 and connected to a power-feeding circuit that is not shown, and shorted conductor plates 15 and 16 extending substantially perpendicularly from two points of outer edges of the radiating conductor plate 13 and connected to the ground conductor surface 12. That is, the shorted conductor plate 15 extends downward, as viewed in FIG. 1, from an outer edge corresponding to one of the shorter sides of the radiating conductor plate 13, and the power-feeding conductor plate 14 the shorted conductor plate 16 extend in parallel downward, as viewed in FIG. 1, from an outer edge corresponding to one of the longer sides of the radiating conductor plate 13.

In the inverted-F metal plate antenna, when a predetermined high-frequency electric power is supplied to the radiating conductor plate 13 via the power-feeding conductor plate 14, a first resonance mode in which the shorted conductor plate 15 works as a shorted stub and a second resonance mode in which the shorted conductor plate 16 works as a shorted stub are generated, causing excitation of the radiating conductor plate 13. Thus, as shown in FIG. 2, in the reflection characteristics of the inverted-F metal plate antenna 11, the voltage to stationary wave ratio (VSWR) is not larger than 2 and the amount of reflection is not larger than −10 dB over a wide band from the proximity of a lower frequency $f_1$ associated with the first resonance mode to the proximity of a higher frequency $f_2$ associated with the second resonance mode. That is, the resonant frequency range (bandwidth) is considerably wide. For example, when the inverted-F metal plate antenna 11 is used in a wireless LAN that operates in the 5 GHz band, a bandwidth of approximately 1.1 GHz is achieved, so that the antenna exhibits favorable characteristics over an extremely wide band.

As described above, in the inverted-F metal plate antenna 11, the two shorted conductor plates 15 and 16 are disposed such that the shorted conductor plates 15 and 16 respectively cause two different resonance modes with different resonant lengths when power is supplied. Accordingly, a considerably increased resonant frequency band is achieved. Furthermore, the two shorted conductor plates 15 and 16 both extend substantially perpendicularly from outer edges of the radiating conductor plate 13. Accordingly, the lengthwise dimension of the radiating conductor plate 13 can be chosen to be approximately one fourth of the resonant length associated with the lower frequency f1, so that miniaturization of the inverted-F metal plate antenna 11 is not compromised. Furthermore, since the inverted-F metal plate antenna 11 can be readily formed by bending a sheet of metal plate, manufacturing cost is extremely low.

Figure 3:
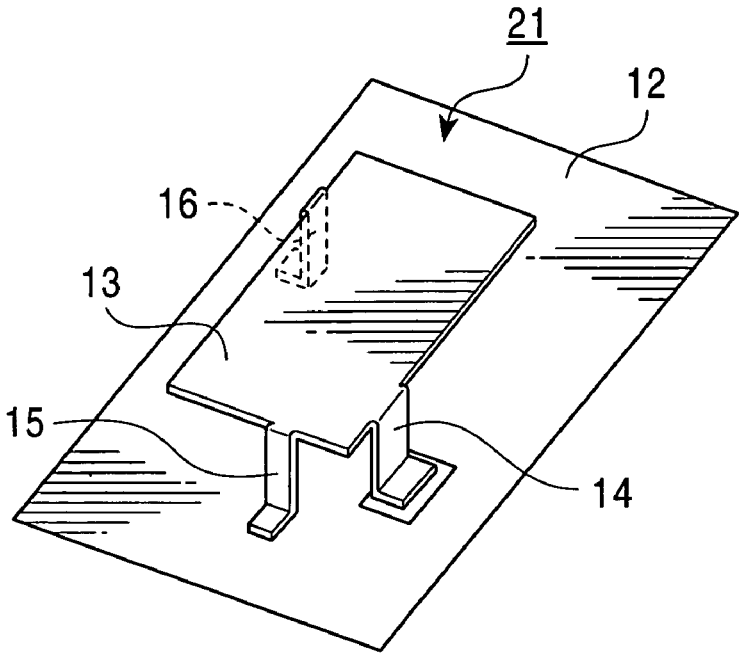
FIG. 3 is a perspective view of an inverted-F metal plate antenna according to another embodiment of the present invention.

FIG. 3 is a perspective view of an inverted-F metal plate antenna according to another embodiment of the present invention. In FIG. 3, parts corresponding to those in FIG. 1 are designated with the same numerals.

Referring to FIG. 3, an inverted-F metal plate antenna 21 differs from the inverted-F metal plate antenna 11 according to the embodiment described above in the position of the shorted conductor plate 16 that works as a shorted stub in the second resonance mode with a relatively short resonant length. The other components, i.e., the radiating conductor plate 13, the power-feeding conductor plate 14, and the shorted conductor plate 15, are equivalent to those in the embodiment described above. That is, the shorted conductor plate 15 that works as a shorted stub for the first resonant mode with a relatively long resonant length extends downward, as viewed in FIG. 3, from an outer edge corresponding to one of the shorter sides of the radiating conductor plate 13. The power-feeding conductor plate 14 extends downward, as viewed in FIG. 3, from an outer edge corresponding to one of the longer sides of the radiating conductor plate 13. The shorted conductor plate 16 extends downward, as viewed in FIG. 3, from an outer edge corresponding to the other longer side of the radiating conductor plate 13. Thus, the shorted conductor plate 16 is placed remote from the feeding conductor plate 14.

Figure 4:
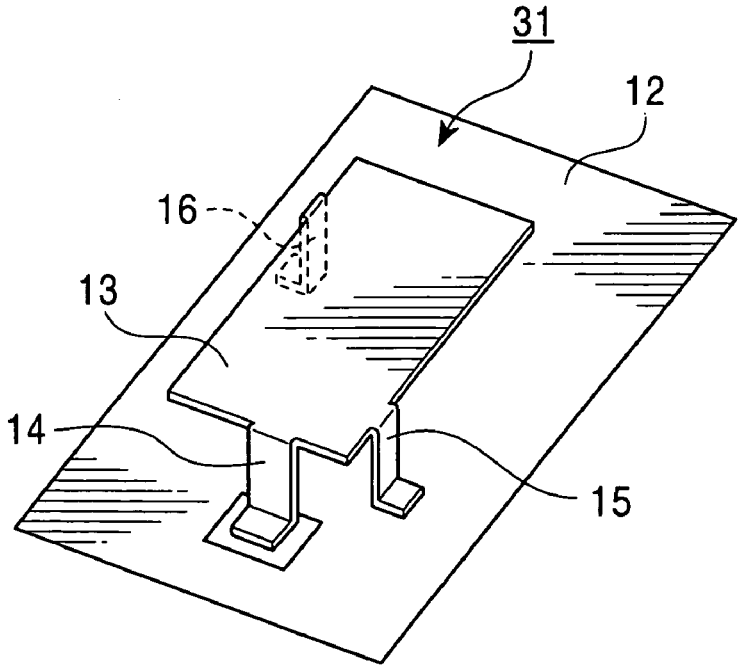
FIG. 4 is a perspective view of an inverted-F metal plate antenna according to yet another embodiment of the present invention.
Figure 5:
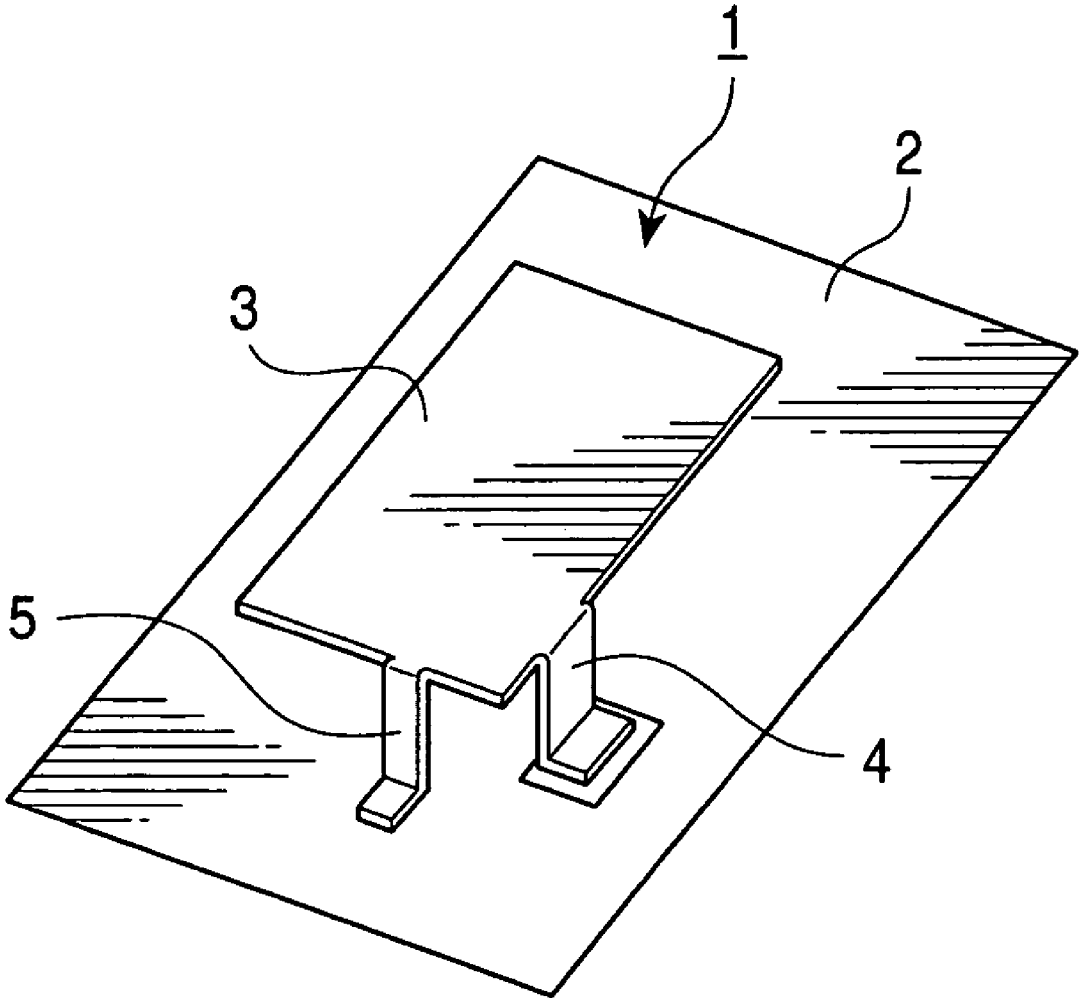
FIG. 5 PRIOR ART
FIG. 5 is a perspective view of a common inverted-F metal plate antenna that has been known.

FIG. 4 is a perspective view of an inverted-F metal plate antenna according to yet another embodiment of the present invention. In FIG. 4, parts corresponding to those in FIGS. 1 and 3 are designated with the same numerals.

Referring to FIG. 4, in an inverted-F metal plate antenna 31, the feeding conductor plate 14 extends downward, as viewed in FIG. 4, from an outer edge corresponding to one of the shorter sides of the radiating conductor plate 13. The shorted conductor plate 15 that works as a shorted stub for the first resonance mode with a relatively long resonant length extends downward, as viewed in FIG. 4, from an outer edge corresponding to one of the longer sides of the radiating conductor plate 13. The shorted conductor plate 16 that works as a shorted stub for the second resonance mode with a relatively short resonant length extends downward, as viewed in FIG. 4, from an outer edge corresponding to the other longer side of the radiating conductor plate 13. The shorted conductor plate 15 is formed in proximity to the power-feeding conductor plate 14, while the shorted conductor plate 16 is formed remote from the power-feeding conductor plate 14.

Although the embodiments have been described by way of examples where shorted conductor plates extend from two points of outer edges of a radiating conductor plate, the number of shorted conductor plates may be increased in order to allow an inverted-F metal plate antenna to operate in a wider band.

What is claimed is:

1. An inverted F-metal plate antenna fixed on a ground conductor surface, comprising:

a radiating conductor plate disposed opposing and substantially in parallel with the ground conductor surface;

a power-feeding conductor plate that is bent to extend substantially perpendicularly from an outer edge of the radiating conductor plate and connected to power-feeding circuit; and at least a first and a second shorted conductor plates that are bent to extend substantially perpendicularly from a plurality of points on outer edges of the radiating conductor plate and connected to the ground conductor surface, the first and second shorted conductor plates having different distances to the power-feeding conductor plate;

wherein a broadband-frequency signal including a frequency component that resonates at a position of the first shorted conductor and a frequency component that resonates at a position of the second shorted conductor is fed to the power-feeding conductor plate.

* * * * *